US008763378B2

(12) United States Patent
Gonze et al.

(10) Patent No.: US 8,763,378 B2
(45) Date of Patent: Jul. 1, 2014

(54) ELECTRICALLY HEATED PARTICULATE FILTER EMBEDDED HEATER DESIGN

(75) Inventors: Eugene V. Gonze, Pinckney, MI (US); Mark R. Chapman, Brighton, MI (US)

(73) Assignee: GM Global Technology Operations LLC

( * ) Notice: Subject to any disclaimer, the term of this patent is extended or adjusted under 35 U.S.C. 154(b) by 1938 days.

(21) Appl. No.: 11/876,121

(22) Filed: Oct. 22, 2007

(65) Prior Publication Data

US 2008/0307775 A1 Dec. 18, 2008

Related U.S. Application Data

(60) Provisional application No. 60/934,986, filed on Jun. 15, 2007.

(51) Int. Cl.
*F01N 3/10* (2006.01)

(52) U.S. Cl.
USPC ..... 60/300; 60/299; 60/303; 60/311

(58) Field of Classification Search
USPC ..... 60/274, 284–287, 300, 303, 297
See application file for complete search history.

(56) References Cited

U.S. PATENT DOCUMENTS

| | | | | | |
|---|---|---|---|---|---|
| 4,456,457 | A | * | 6/1984 | Nozawa et al. | 55/283 |
| 4,505,726 | A | | 3/1985 | Takeuchi | |
| 4,512,786 | A | * | 4/1985 | Sakurai et al. | 55/282 |
| 4,516,993 | A | | 5/1985 | Takeuchi | |
| 4,519,820 | A | * | 5/1985 | Oyobe et al. | 55/284 |
| 4,548,625 | A | * | 10/1985 | Ishida et al. | 55/282 |
| 4,872,889 | A | * | 10/1989 | Lepperhoff et al. | 55/282.3 |
| 4,934,142 | A | * | 6/1990 | Hayashi et al. | 60/297 |
| 4,948,403 | A | * | 8/1990 | Lepperhoff et al. | 55/282 |
| 5,472,462 | A | * | 12/1995 | Pischinger et al. | 55/282 |
| 5,526,462 | A | * | 6/1996 | Kondo et al. | 392/485 |
| 5,584,175 | A | * | 12/1996 | Carlborg et al. | 60/274 |
| 6,102,976 | A | * | 8/2000 | Oji et al. | 55/282.3 |
| 7,862,635 | B2 | * | 1/2011 | Gonze et al. | 55/282.3 |
| 2007/0220869 | A1 | | 9/2007 | Gonze et al. | |

FOREIGN PATENT DOCUMENTS

| | | | | | |
|---|---|---|---|---|---|
| DE | 3403564 | A1 | | 8/1984 | |
| EP | 1167708 | A2 | | 2/2002 | |
| JP | 57179317 | | | 11/1982 | |
| JP | 58-008219 | | | 1/1983 | |
| JP | 58-072609 | | | 4/1983 | |
| JP | 2003-027922 | | | 1/2003 | |
| JP | 2003027922 | | * | 1/2003 | F01N 3/02 |

* cited by examiner

*Primary Examiner* — Jesse Bogue

(57) ABSTRACT

An exhaust system that processes exhaust generated by an engine is provided. The system generally includes a particulate filter (PF) that filters particulates from the exhaust wherein an upstream end of the PF receives exhaust from the engine and wherein an upstream surface of the particulate filter includes machined grooves. A grid of electrically resistive material is inserted into the machined grooves of the exterior upstream surface of the PF and selectively heats exhaust passing through the grid to initiate combustion of particulates within the PF.

20 Claims, 6 Drawing Sheets

ELECTRICALLY HEATED PARTICULATE FILTER EMBEDDED HEATER DESIGN

CROSS-REFERENCE TO RELATED APPLICATIONS

This application claims the benefit of U.S. Provisional Application No. 60/934,986, filed on Jun. 15, 2007. The disclosure of the above application is incorporated herein by reference.

STATEMENT OF GOVERNMENT RIGHTS

This invention was produced pursuant to U.S. Government Contract No. DE-FC-04-03 AL67635 with the Department of Energy (DoE). The U.S. Government has certain rights in this invention.

FIELD

The present disclosure relates to methods and systems for heating particulate filters.

BACKGROUND

The statements in this section merely provide background information related to the present disclosure and may not constitute prior art.

Diesel engines typically have higher efficiency than gasoline engines due to an increased compression ratio and a higher energy density of diesel fuel. A diesel combustion cycle produces particulates that are typically filtered from diesel exhaust by a particulate filter (PF) that is disposed in the exhaust stream. Over time, the PF becomes full and the trapped diesel particulates must be removed. During regeneration, the diesel particulates are burned within the PF.

Conventional regeneration methods inject fuel into the exhaust stream after the main combustion event. The post-combustion injected fuel is combusted over one or more catalysts placed in the exhaust stream. The heat released during the fuel combustion on the catalysts increases the exhaust temperature, which burns the trapped soot particles in the PF. This approach, however, can result in higher temperature excursions than desired, which can be detrimental to exhaust system components, including the PF.

SUMMARY

Accordingly, an exhaust system that processes exhaust generated by an engine is provided. The system generally includes a particulate filter (PF) that filters particulates from the exhaust wherein an upstream end of the PF receives exhaust from the engine and wherein an upstream surface of the particulate filter includes machined grooves. A grid of electrically resistive material is inserted into the machined grooves of the exterior upstream surface of the PF and selectively heats exhaust passing through the grid to initiate combustion of particulates within the PF.

In other features, an exhaust system that processes exhaust generated by an engine is provided. The method generally includes: a catalyst that receives the exhaust from the engine wherein a downstream end of the catalyst releases exhaust from the catalyst and wherein an exterior downstream surface of the particulate filter includes machined grooves; and a grid of electrically resistive material is inserted into the machined grooves of the exterior downstream surface of the catalyst and selectively heats exhaust passing through the grid.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 4:
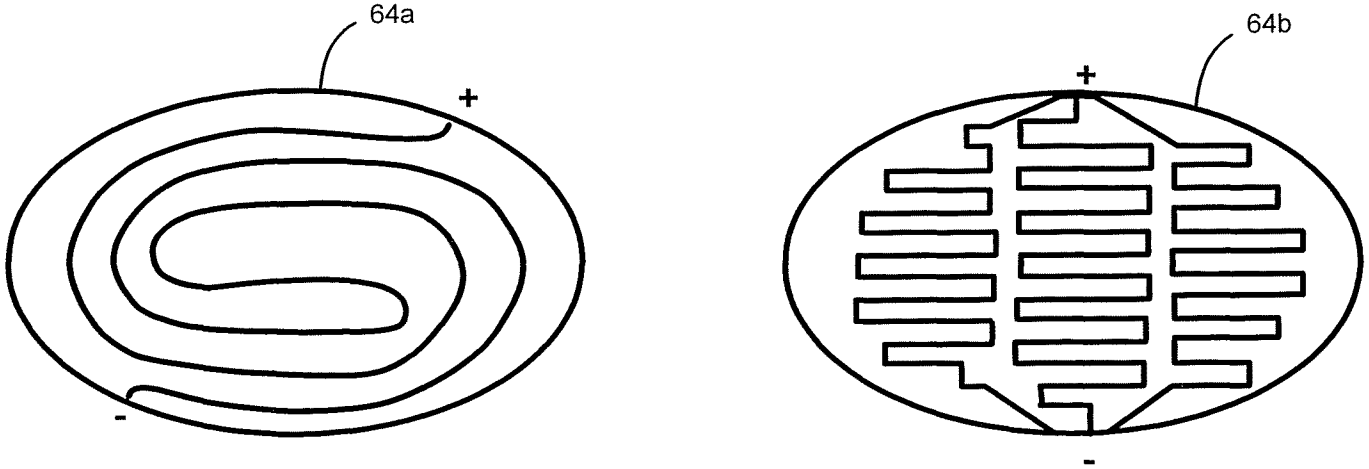

FIG. 4 includes front perspective views of exemplary grids illustrating various patterns of resistive paths.

Figure 5:
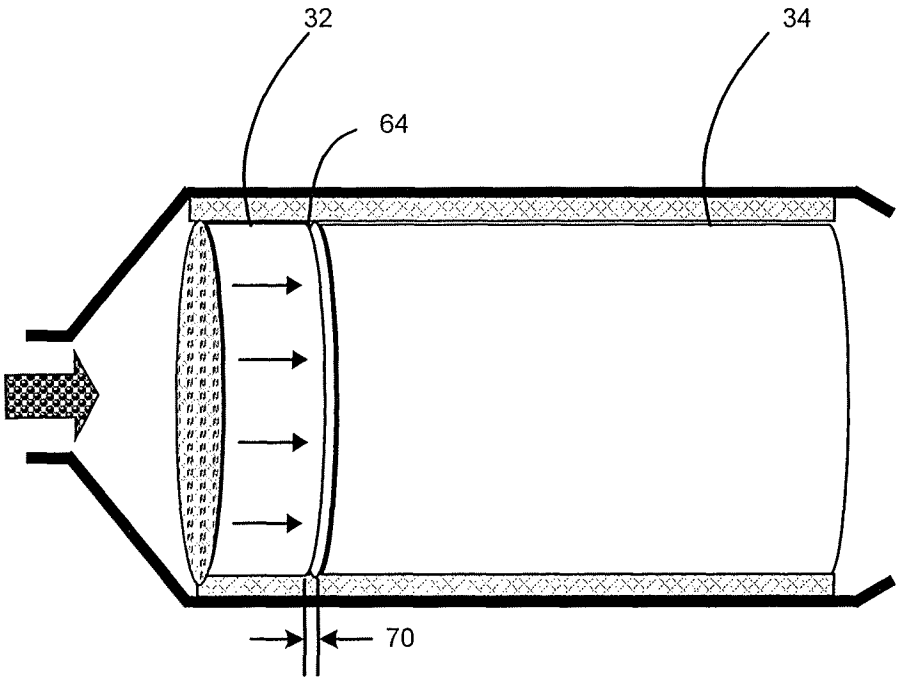

FIG. 5 is a side perspective view of an exemplary catalyst and particulate filter including an embedded resistive grid.

Figure 6:
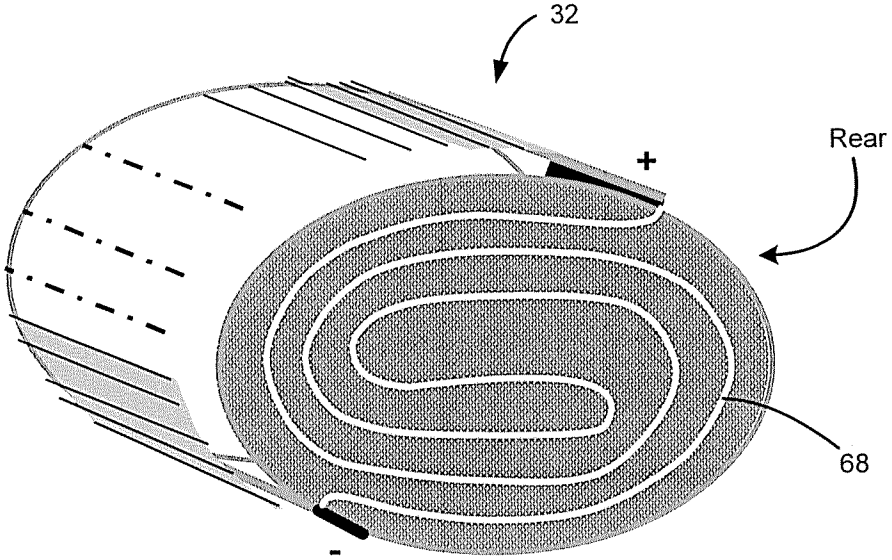

FIG. 6 includes a perspective view of a catalyst including machined grooves.

DETAILED DESCRIPTION

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
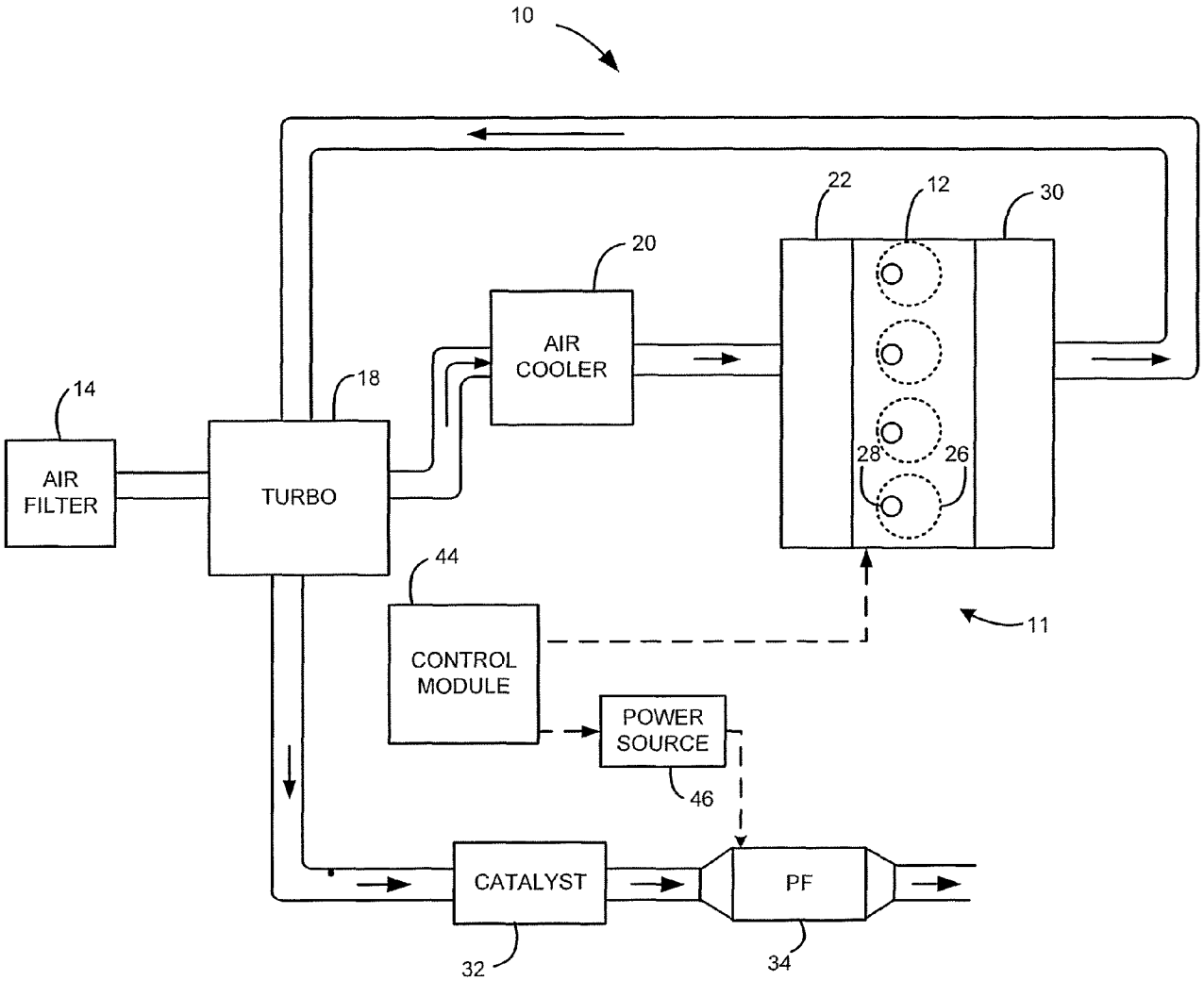
FIG. 1 is a functional block diagram of an exemplary vehicle including a particulate filter and a particulate filter regeneration system according to various aspects of the present disclosure.

Referring now to FIG. 1, an exemplary vehicle 10 including a diesel engine system 11 is illustrated in accordance with various aspects of the present disclosure. It is appreciated that the diesel engine system 11 is merely exemplary in nature and that the particulate filter regeneration system described herein can be implemented in various engine systems implementing a particulate filter. Such engine systems may include, but are not limited to, gasoline direct injection engine systems and homogeneous charge compression ignition engine systems. For ease of the discussion, the disclosure will be discussed in the context of a diesel engine system.

A turbocharged diesel engine system 11 includes an engine 12 that combusts an air and fuel mixture to produce drive torque. Air enters the system by passing through an air filter 14. Air passes through the air filter 14 and is drawn into a turbocharger 18. The turbocharger 18 compresses the fresh air entering the system 11. The greater the compression of the air generally, the greater the output of the engine 12. Compressed air then passes through an air cooler 20 before entering into an intake manifold 22.

Air within the intake manifold 22 is distributed into cylinders 26. Although four cylinders 26 are illustrated, it is appreciated that the systems and methods of the present disclosure can be implemented in engines having a plurality of cylinders including, but not limited to, 2, 3, 4, 5, 6, 8, 10 and 12 cylinders. It is also appreciated that the systems and methods of the present disclosure can be implemented in a v-type cylinder configuration. Fuel is injected into the cylinders 26 by fuel injectors 28. Heat from the compressed air ignites the air/fuel mixture. Combustion of the air/fuel mixture creates exhaust. Exhaust exits the cylinders 26 into the exhaust system.

The exhaust system includes an exhaust manifold 30, a diesel oxidation catalyst (catalyst) 32, and a particulate filter (PF) 34. Optionally, an EGR valve (not shown) re-circulates a portion of the exhaust back into the intake manifold 22. The remainder of the exhaust is directed into the turbocharger 18 to drive a turbine. The turbine facilitates the compression of the fresh air received from the air filter 14. Exhaust flows from the turbocharger 18 through the catalyst 32 and the PF 34. The catalyst 32 oxidizes the exhaust based on the post combustion air/fuel ratio. The PF 34 receives exhaust from the catalyst 32 and filters any particulate matter particulates present in the exhaust.

A control module 44 controls the engine 12 and PF regeneration based on various sensed and/or modeled information. More specifically, the control module 44 estimates particulate matter loading of the PF 34. When the estimated particulate matter loading achieves a threshold level (e.g., 5 grams/liter of particulate matter) and the exhaust flow rate is within a desired range, current is controlled to the PF 34 via a power source 46 to initiate the regeneration process. The duration of the regeneration process varies based upon the amount of particulate matter within the PF 34. It is anticipated, that the regeneration process can last between 1-6 minutes. Current is only applied, however, during an initial portion of the regeneration process. More specifically, the electric energy heats the face of the PF 34 for a threshold period (e.g., 1-2 minutes). Exhaust passing through the front face is heated. The remainder of the regeneration process is achieved using the heat generated by combustion of the particulate matter present near the heated face of the PF 34 or by the heated exhaust passing through the PF 34.

Figure 2:
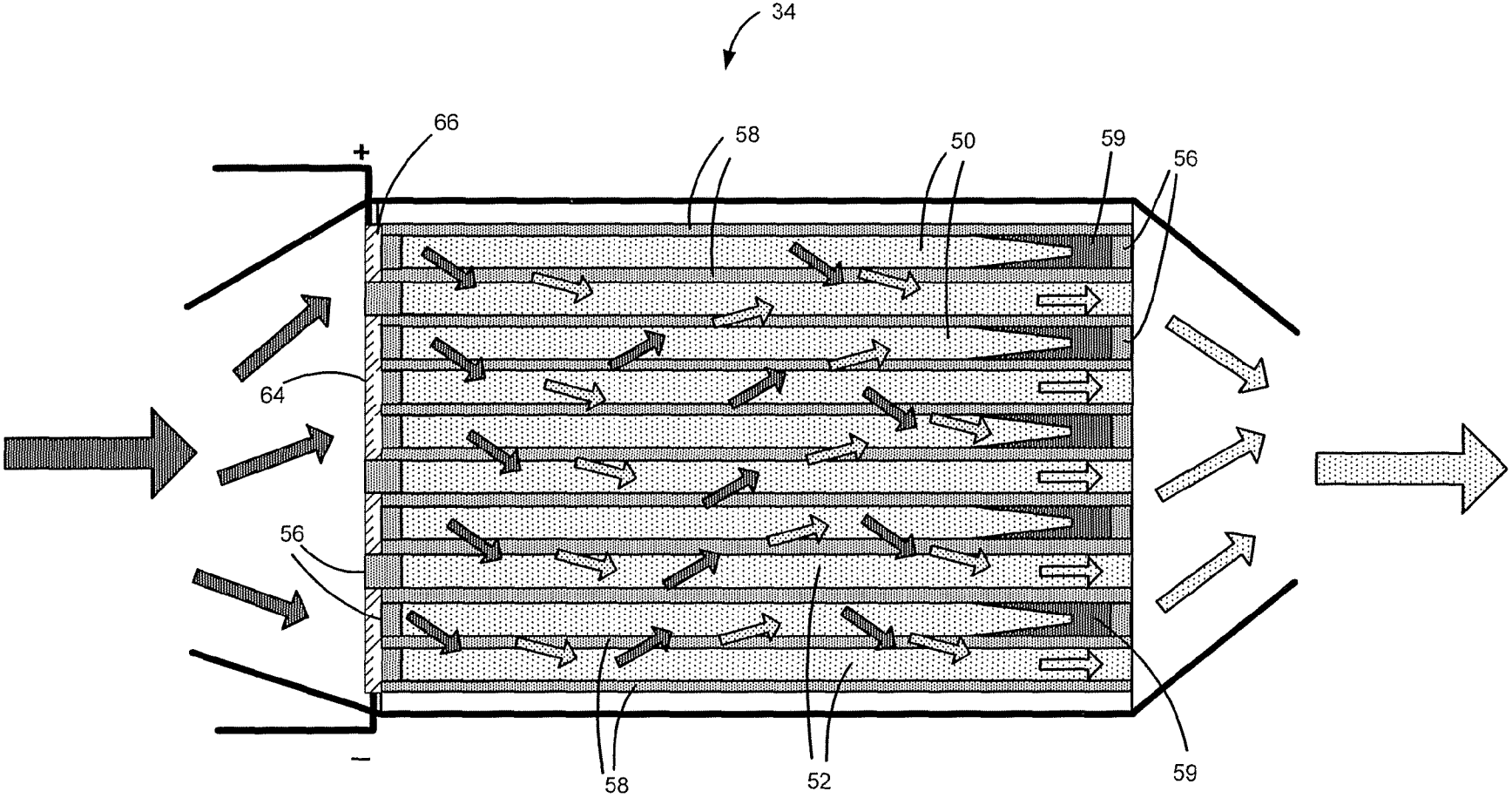
FIG. 2 is a cross-sectional view of an exemplary wall-flow monolith particulate filter including an embedded resistive grid.

With particular reference to FIG. 2, the PF 34 is preferably a monolith particulate trap and includes alternating closed cells/channels 50 and opened cells/channels 52. The cells/channels 50, 52 are typically square cross-sections, running axially through the part. Walls 58 of the PF 34 are preferably comprised of a porous ceramic honeycomb wall of cordierite material. It is appreciated that any ceramic comb material is considered within the scope of the present disclosure. Adjacent channels are alternatively plugged at each end as shown at 56. This forces the diesel aerosol through the porous substrate walls which act as a mechanical filter. Particulate matter is deposited within the closed channels 50 and exhaust exits through the opened channels 52. Particulate matter 59 flow into the PF 34 and are trapped therein.

Figure 3:
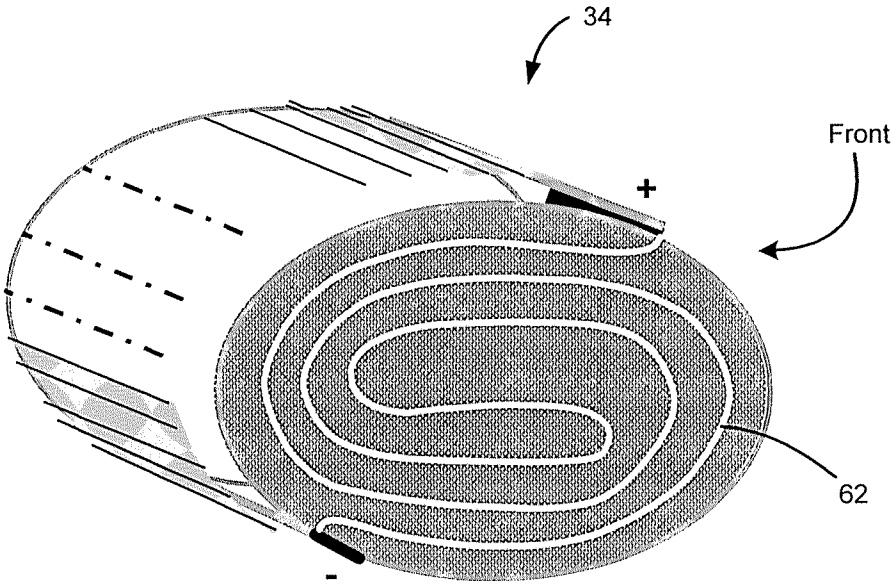
FIG. 3 is a perspective view of the particulate filter of FIG. 2 including machined grooves.

With reference to FIG. 3 and continued reference to FIG. 2, for regeneration purposes, one or more portions of a front or upstream exterior surface (also referred to as the front face) of the PF 34 is machined or milled to form grooves 62. As shown in FIG. 3, the grooves 62 are machined to accommodate a grid 64 including an electrically resistive material. The grooves 62 can be machined in various patterns to match a pattern of the grid 64. As can be appreciated, the resistive material of the grid 64 may be formed in various single or multi-path patterns as shown in FIG. 4. The grid 64 can be attached to the front face of the PF 34 by inserting the grid 64 into the grooves 62. When in place, the grooves 62 help to maintain the position of the grid 64 and the grid 64 is in laminar flow with the PF 34. In addition, the grid 64 at least partially forms an uncovered portion of the upstream exterior surface of the PF 34.

In various embodiments, a depth of the grooves 62 can be such that when the grid 64 is attached to the PF 34, a gap 66 exists between the PF 34 and the grid 64 a shown in FIG. 2. The gap 66 allows for thermal expansion when the grid 64 is heated (as will be discussed further below). In various embodiments, the grid 64 is composed of electrically resistive material that is capable of low thermal expansion (such as, e.g., INVAR 42 including 42% Nickel and 58% Iron).

With reference to FIGS. 5 and 6, in various other embodiments, when the vehicle 10 includes a catalyst 32, one or more portions of a rear or downstream exterior surface (also referred to as the rear face) of the catalyst 32 can be machined or milled to form grooves 68. As shown in FIG. 6, the grooves 68 are machined to accommodate the grid 64. As discussed above, the grooves 68 can be machined in various patterns to match the pattern of the grid 64. The grid 64 can be inserted between the catalyst 32 and the PF 34 by inserting the grid 64 to the grooves 68 of the rear face of the catalyst 32. When in place, the grooves 68 help to maintain the position of the grid 64 and the grid 64 is in laminar flow with the PF 34. In addition, the grid 64 at least partially forms an uncovered portion of the downstream exterior surface of the catalyst 32, as a gap 70 exists between the catalyst 32 and the PF 34.

In various embodiments, a depth of the grooves 68 can be such that when the grid 64 is attached to the catalyst 32, a gap (similarly shown as 66 in FIG. 2) exists between the catalyst 32 and the grid 64. The gap allows for thermal expansion when the grid 64 is heated (as will be discussed further below). In various embodiments, the grid 64 is composed of electrically resistive material that is capable of low thermal expansion (such as, e.g., INVAR 42 including 42% Nickel and 58% Iron).

In any of the above mentioned embodiments, current is supplied to the grid 64 to heat the grid 64. Exhaust passing through the grid 64 carries thermal energy generated by the grid 64 a short distance down the channels 50, 52 of the PF 34. Embedding the grid 64 in the PF 34 or the catalyst 32 limits the radiant heat loss. The thermal energy ignites the particulate matter present near the front of the PF 34. The heat generated from the combustion of the particulates is then directed through the PF 34 to induce combustion of the remaining particulates within the PF 34.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. An exhaust system that processes exhaust generated by an engine, comprising:

a catalyst that receives the exhaust from the engine wherein a downstream end of the catalyst releases exhaust from the catalyst and wherein a downstream surface of the catalyst includes grooves; and a grid of electrically resistive material that is inserted into the grooves to at least partially form an uncovered portion of the downstream surface of the catalyst and that selectively heats exhaust passing through the grid.

2. The system of claim 1 further comprising a particulate filter (PF) disposed downstream of the catalyst and that filters particulates from the exhaust and wherein the heated exhaust from the grid initiates combustion of particulates within the PF.

3. The system of claim 1 wherein the grooves are formed in a first pattern, wherein the grid of electrically resistive material is formed in a second pattern, and wherein the first pattern matches the second pattern.

4. The system of claim 3 wherein the second pattern is a single path pattern.

5. The system of claim 3 wherein the second pattern is a multi-path pattern.

6. The system of claim 1 wherein the grooves include a depth that allows for a gap between the grid and the catalyst when the grid is inserted into the grooves.

7. The system of claim 1 wherein the electrically resistive material is composed of a low thermal expansion material selected from the group comprising: iron and nickel.

8. The system of claim 2 further comprising a control module that controls current to the grid during an initial period of a PF regeneration cycle.

9. The system of claim 8 wherein the control module estimates an amount of particulates within the PF and wherein the current is controlled when the amount exceeds a threshold amount.

10. The system of claim 1 wherein the grooves engage the grid to maintain the grid in position in the grooves.

11. A method of using an exhaust system to process exhaust generated by an engine, comprising:

inserting a grid of electrically resistive material into grooves in a downstream surface of a catalyst to at least partially form an uncovered portion of the downstream surface of the catalyst;

positioning the catalyst in the exhaust system such that the catalyst receives exhaust from the engine and a downstream end of the catalyst releases exhaust from the catalyst; and selectively supplying current to the grid to heat exhaust passing through the grid.

12. The method of claim 11 further comprising positioning a particulate filter (PF) downstream of the catalyst, wherein:

the PF filters particulates from the exhaust; and the heated exhaust from the grid initiates combustion of particulates within the PF.

13. The method of claim 11 wherein the grooves are formed in a first pattern, wherein the grid of electrically resistive material is formed in a second pattern, and wherein the first pattern matches the second pattern.

14. The method of claim 13 wherein the second pattern is a single path pattern.

15. The method of claim 13 wherein the second pattern is a multi-path pattern.

16. The method of claim 11 wherein the grooves include a depth that allows for a gap between the grid and the catalyst when the grid is inserted into the grooves.

17. The method of claim 11 wherein the electrically resistive material is composed of a low thermal expansion material selected from a group comprising: iron and nickel.

18. The method of claim 12 further comprising supplying current to the grid during an initial period of a PF regeneration cycle.

19. The method of claim 18 further comprising:

estimating an amount of particulates within the PF; and supplying current to the grid when the amount of particulates within the PF is greater than a threshold amount.

20. The method of claim 11 wherein the grooves engage the grid to maintain the grid in position in the grooves.

* * * * *